US012486753B2

(12) United States Patent
Lei et al.

(10) Patent No.: US 12,486,753 B2
(45) Date of Patent: Dec. 2, 2025

(54) WELLBORE STAGED OPERATION METHOD AND RUBBER PLUG FOR SAID METHOD

(71) Applicants: CHINA PETROLEUM & CHEMICAL CORPORATION, Beijing (CN); SINOPEC SOUTHWEST OIL & GAS COMPANY, Sichuan (CN)

(72) Inventors: Wei Lei, Sichuan (CN); Zhimin Hou, Sichuan (CN); Haifeng Dong, Sichuan (CN); Yancheng Yan, Sichuan (CN); Lin Lan, Sichuan (CN); Xingwen Wang, Sichuan (CN); Xiaogang Wang, Sichuan (CN); Zhiguo Qiao, Sichuan (CN); Zhou Fang, Sichuan (CN)

(73) Assignees: CHINA PETROLEUM & CHEMICAL CORPORATION, Beijing (CN); SINOPEC SOUTHWEST OIL & GAS COMPANY, Sichuan (CN)

( * ) Notice: Subject to any disclaimer, the term of this patent is extended or adjusted under 35 U.S.C. 154(b) by 323 days.

(21) Appl. No.: 18/001,537

(22) PCT Filed: Jun. 10, 2021

(86) PCT No.: PCT/CN2021/099475
§ 371 (c)(1),
(2) Date: Dec. 12, 2022

(87) PCT Pub. No.: WO2021/249499
PCT Pub. Date: Dec. 16, 2021

(65) Prior Publication Data

US 2023/0235655 A1 Jul. 27, 2023

(30) Foreign Application Priority Data

Jun. 12, 2020 (CN) ..... 202010534828.0
Jun. 12, 2020 (CN) ..... 202010534849.2
Jun. 28, 2020 (CN) ..... 202010596721.9

(51) Int. Cl.
*E21B 33/13* (2006.01)
*E21B 43/26* (2006.01)

(52) U.S. Cl.
CPC ..... *E21B 43/261* (2013.01); *E21B 33/13* (2013.01)

(58) Field of Classification Search
CPC ..... E21B 43/261; E21B 33/13
(Continued)

(56) References Cited

U.S. PATENT DOCUMENTS 3,948,322 A * 4/1976 Baker ..... E21B 33/127 166/187
9,976,394 B1 * 5/2018 Campbell ..... E21B 43/10
(Continued)

FOREIGN PATENT DOCUMENTS

CA 2887292 A1 10/2016
CN 102733789 A 10/2012
(Continued)

OTHER PUBLICATIONS

Zhang, Wei; "Research and Application of Cementing Supporting Technology for Tight Oil Horizontal Wells"; Western Exploration Engineering, vol. 1, 2020; pp. 85-87, and 92.
(Continued)

*Primary Examiner* — William D Hutton, Jr.
*Assistant Examiner* — Ashish K Varma
(74) *Attorney, Agent, or Firm* — NKL Law; Allen Xue

(57) ABSTRACT

A wellbore staged operation method includes running, after a first well drifting operation is performed on a wellbore, a
(Continued)

pipe string (100) in the wellbore, wherein the pipe string (100) includes, along a direction from bottom to top, a floating hoop (2), a plug seat (7), a toe-end sliding sleeve (3), and a fracturing sliding sleeve (4); performing a cementing operation, wherein cement slurry pumped into an inner chamber of the pipe string (100) enters an annulus between the pipe string and the wellbore through the plug seat (7) and the floating hoop (2) to form a cement sheath, the cement sheath isolating the toe-end sliding sleeve (3) from the fracturing sliding sleeve (4); performing a second drifting operation to ensure the toe-end sliding sleeve (3) of the pipe string (100) exposed; performing a pressure test for the pipe string; and performing staged fracturing constructions.

12 Claims, 7 Drawing Sheets

(58) Field of Classification Search
USPC ..... 166/281
See application file for complete search history.

(56) References Cited

U.S. PATENT DOCUMENTS

| | | | | |
|---|---|---|---|---|
| 2009/0151938 | A1* | 6/2009 | Conkle | E21B 7/00 166/308.1 |
| 2014/0034319 | A1* | 2/2014 | Surjaatmadja | E21B 43/26 166/305.1 |
| 2014/0246207 | A1* | 9/2014 | Hofman | E21B 43/12 166/373 |

FOREIGN PATENT DOCUMENTS

| | | | |
|---|---|---|---|
| CN | 103758494 | A | 4/2014 |
| CN | 203716926 | U | 7/2014 |
| CN | 204126624 | U | 1/2015 |
| CN | 204186371 | U | 3/2015 |
| CN | 104563936 | A | 4/2015 |
| CN | 104612647 | A | 5/2015 |
| CN | 105003220 | A | 10/2015 |
| CN | 105134154 | A | 12/2015 |
| CN | 205135571 | U | 4/2016 |
| CN | 105888639 | A | 8/2016 |
| CN | 106246104 | A | 12/2016 |
| CN | 106285556 | A | 1/2017 |
| CN | 106639968 | A | 5/2017 |
| CN | 206513347 | U | 9/2017 |
| CN | 206617151 | U | 11/2017 |
| CN | 207761622 | U | 8/2018 |
| CN | 207988994 | U | 10/2018 |
| CN | 207999237 | U | 10/2018 |
| CN | 208347705 | U | 1/2019 |
| CN | 109899017 | A | 6/2019 |
| CN | 209261535 | U | 8/2019 |
| CN | 110374571 | A | 10/2019 |
| CN | 110593837 | A | 12/2019 |
| CN | 212389307 | U | 1/2021 |
| GB | 2360802 | A | 10/2001 |
| RU | 2490426 | C1 | 8/2013 |
| RU | 2571460 | C2 | 12/2015 |
| RU | 2601641 | C2 | 11/2016 |
| WO | 2014197832 | A1 | 12/2014 |
| WO | 2020076584 | A1 | 4/2020 |
| WO | 2020117814 | A1 | 6/2020 |

OTHER PUBLICATIONS

Ding, Jinzhao et al.; "Analysis of Oil Spill Risks in Offshore Oil Development and Measures for Prevention of Oil Spill"; Ocean Press, May 2016; pp. 126-128.

Zou, Chuanyuan et al.; "Development and Application of Whole Vulcanization Type Dril Pipe Plug"; Drilling & Production Technology; vol. 38, No. 5; Sep. 2015; pp. 66-70.

* cited by examiner

WELLBORE STAGED OPERATION METHOD AND RUBBER PLUG FOR SAID METHOD

CROSS REFERENCE TO RELATED APPLICATIONS

This application is a U.S. national stage entry of PCT international application no. PCT/CN2021/099475, filed on Jun. 10, 2021, which claims the priorities of Chinese patent application No. 202010534849.2 entitled "Staged stimulation pipe string for well cementation and method" and filed on Jun. 12, 2020, Chinese patent application No. 202010534828.0 entitled "Wellbore operation preparation method for single channel well construction" and filed on Jun. 12, 2020, and Chinese patent application No. 202010596721.9 entitled "Rubber plug and bumping tool for tubing cementation including the same" and filed on Jun. 28, 2020, the content of each is incorporated herein by reference in its entirety.

TECHNICAL FIELD

The present invention relates to the technical field of oil/gas field production, and in particular to a wellbore staged operation method and a rubber plug used for the wellbore staged operation method.

TECHNICAL BACKGROUND

For existing oil/gas reservoirs, especially dense oil/gas reservoirs, staged stimulation technology is usually used for well construction, including operation steps of well cementing, well completing, fracturing and so on. A common fracturing mode is staged fracturing for long horizontal section, and the well completion methods corresponding thereto mainly include casing perforation staged completion and open hole staged completion.

The casing perforation staged completion and the open hole staged completion each include quite a few relevant processes, so that a variety of equipment should be lowered into the well to perform various operations. For example, the casing perforation staged completion includes steps of drifting after drilling, casing cementation, sound measurement, drifting, perforation, scraping the pipe, running the staged completion pipe string, mud displacement, and so on. The open hole staged completion includes steps of simulated drifting in the horizontal section after drilling, pushing-releasing the open hole staged pipe string through the drill rod, mud displacement in the horizontal section, sealing the packer through ball-off, drop-off, mud displacement in the vertical section, pulling-pushing-releasing the pipe string, running the tie-back string, and so on.

The conventional staged well completion process as mentioned above requires quite a few steps, long operation period, and a variety of equipment. This leads to high well construction costs and low development benefits for dense oil/gas reservoirs. Therefore, it is difficult for the conventional well completion technology to meet the production needs.

SUMMARY OF THE INVENTION

Aiming at some or all of the above technical problems existing in the prior arts, the present invention proposes a wellbore staged operation method, whereby well cementation, well completion and fracturing operations can be realized at one time. The method only requires several steps and thus has a short operation period, and can be widely used in different types of oil/gas reservoirs. The present invention further proposes a rubber plug for such a wellbore staged operation method.

According to a first aspect of the present invention, a wellbore staged operation method is provided, comprising steps of: running, after a first well drifting operation is performed on a wellbore, a pipe string in the wellbore, wherein the pipe string includes, along a direction from bottom to top, a floating hoop, a plug seat, a toe-end sliding sleeve, and a fracturing sliding sleeve; performing a cementing operation, wherein cement slurry pumped into an inner chamber of the pipe string enters an annulus between the pipe string and the wellbore through the plug seat and the floating hoop to form a cement sheath, the cement sheath isolating the toe-end sliding sleeve from the fracturing sliding sleeve; performing a second drifting operation to ensure the toe-end sliding sleeve of the pipe string exposed; performing a pressure test for the pipe string; and performing staged fracturing construction.

In a preferred embodiment, the step of performing the cementing operation comprises: pumping a prepad liquid into the pipe string, wherein the prepad liquid enters the annulus between the pipe string and the wellbore through the plug seat and the floating hoop for cleaning; pumping the cement slurry to enter the annulus between the pipe string and the wellbore through the plug seat and the floating hoop; throwing a rubber plug in the wellbore, and pumping a displacing fluid to drive the rubber plug to move down, until it bumps with the plug seat; and shutting down the well for pressure build-up, and waiting on cement.

In a specific embodiment, the prepad liquid is pumped with a volume selected such that a liquid section with a length of 200-300 m is formed in the annulus.

In a specific embodiment, the cement slurry is pumped with a volume selected such that a return height of the cement slurry is at least 200 m above the fracturing sliding sleeve.

In a specific embodiment, the pressure build-up is performed to a pressure of 3-5 MPa higher than a liquid column pressure difference.

In a preferred embodiment, the step of performing the second drifting operation comprises: performing a plugging operation to determine a position of the rubber plug; and judging whether the position of the rubber plug is above the toe-end sliding sleeve, and if yes, further performing a plug-removing operation.

In a specific embodiment, the plugging operation is performed with a coiled tubing connected to a plugging string, wherein an outer diameter of the coiled tubing is 20-30 mm smaller than an inner diameter of the pipe string, and a maximum outer diameter of the plugging string is 3-5 mm smaller than the inner diameter of the pipe string, the coiled tubing having a running speed of 10-20 m/min.

In a preferred embodiment, pressurization is repeated several times if the coiled tubing is hindered at a position during running, and said position is the position of the rubber plug if the position where the coiled tubing is hindered remains unchanged.

In a specific embodiment, the plug-removing operation is performed by a coiled tubing connected with a plug-removing string, a maximum outer diameter of the plug-removing string being 6-8 mm smaller than the inner diameter of the pipe string.

In a specific embodiment, the rubber plug is drilled out to a position 10-20 m below a bottom surface of the toe-end sliding sleeve.

In a specific embodiment, the rubber plug is drilled out through pumping a plug-removing working fluid to drive a drill bit via the plug-removing string, the plug-removing working fluid being pumped with a displacement of 300-500 L/min.

In a preferred embodiment, an operation of displacing the plug-removing working fluid in the pipe string is performed after the plug-removing operation.

In a preferred embodiment, the coiled tubing is lifted up after contacting with the rubber plug in the pipe string, and a well-construction working fluid is pumped to displace the plug-removing working fluid in the pipe string.

In a preferred embodiment, a value of pumping pressure of the well-construction working fluid decreases stepwise.

In a preferred embodiment, the well-construction working fluid is a reaction fluid acting on the sliding sleeves of the pipe string, wherein a spacer liquid is pumped before the well-construction working fluid.

According to a second aspect of the present invention, a rubber plug used in the wellbore staged operation method mentioned above is provided, comprising: a plug core, including an inserting head, a main body and a connecting tail, wherein an annular mounting groove is arranged on an outer wall of the inserting head; a cup arranged on an outer wall of the connecting tail; and a locking member arranged in the mounting groove.

In a preferred embodiment, the mounting groove includes a first straight section adjacent to the main body of the plug core, and a first slope section adjacent to the first straight section, the first slope section being configured such that an outer diameter of the inserting head of the rubber plug gradually increases. The locking member is configured as a C-shaped ratchet ring, an inner wall surface of which includes a first straight mating section at an upper part thereof in engagement with the first straight section, and a first slope mating section at a lower part thereof in engagement with the first slope section. An upper end face of the C-shaped ratchet ring abuts against a lower end face of the main body of the plug core.

In a preferred embodiment, the inserting head of the plug core includes a second straight section connected to the first slope section, a second slope section connected to the second straight section, and a guide section connected to the second slope section. The second slope section is configured such that an outer diameter of the inserting head gradually decreases from top to bottom, and the guide section is configured as a spherical surface.

In a preferred embodiment, a first step face facing upwardly, a second step face facing downwardly, and a sealing groove for receiving a sealing ring are formed on an outer wall of the main body of the plug core, the second step face being located below the first step face, and the sealing groove being arranged between the first step face and the second step face.

In a preferred embodiment, a transiting section with a relatively increased outer diameter is provided on the upper end of the main body of the plug core, an outer diameter of a main body of the cup being the same as that of the transiting section.

BRIEF DESCRIPTION OF THE DRAWINGS

In the following preferred embodiments of the present invention will be described in detail with reference to the accompanying drawings. In the drawings.

In the drawings, the same reference numerals are used to indicate the same components. The drawings are not drawn to actual scale.

DETAILED DESCRIPTION OF EMBODIMENTS

The present invention will be further described below with reference to the accompanying drawings. In the context of the present invention, directional terms "upper", "upstream", "upward" or the like refer to a direction toward the wellhead, while directional terms "down", "downstream", "downward" or the like refer to a direction away from the wellhead. In addition, the radial direction toward the formation is indicated as "radially outside", while that away from the formation is indicated as "radially inside".

Figure 1:
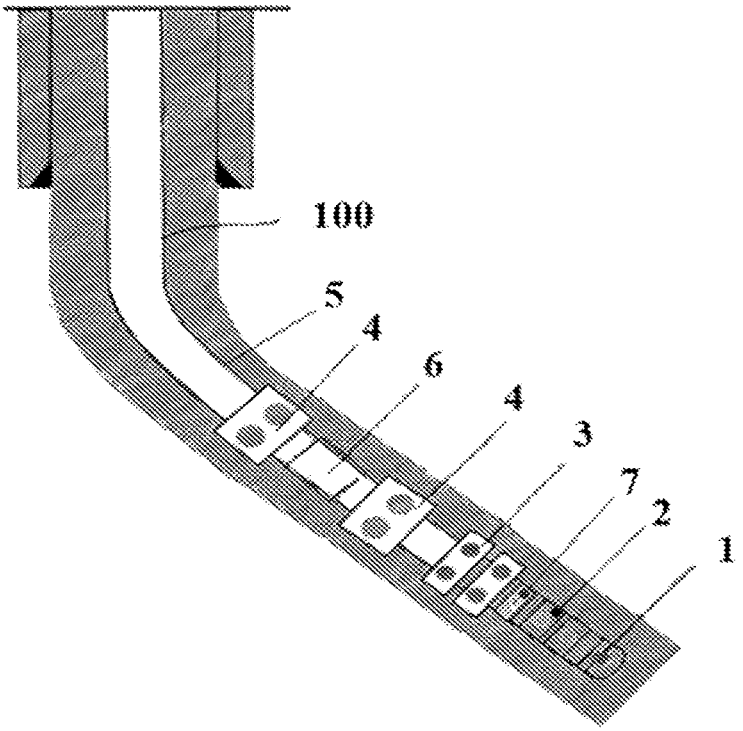
FIG. 1 shows a pipe string according to one embodiment of the present invention.

FIG. 1 shows a pipe string 100 according to an embodiment of the present invention, which is suitable for a deviated well section. As shown in FIG. 1, the pipe string 100 mainly includes a floating shoe 1, a floating hoop 2, a plug seat 7, a toe-end sliding sleeve 3, a fracturing sliding sleeve 4, a tubing 5, and a centralizer 6. The floating shoe 1 is arranged at an end of the pipe string 100, in order to facilitate that the pipe string 100 can be lowered into the wellbore smoothly.

The floating hoop 2 is arranged on an upper end of the floating shoe 1, for ensuring the pipe string 100 can be lowered smoothly. At the same time, the floating hoop 2 is used as a passageway communicating an inner chamber of the pipe string 100 with the wellbore during well cementation, and also used to receive a rubber plug that is lowered into the inner chamber of the pipe string 100 later, which will be described in detail in the following. In an embodiment of the present invention not shown, the pipe string 100 includes two floating hoops 2 spaced from each other along an axial direction of the pipe string, so as to improve the safety of operation and ensure smooth operations, such as well cementation or the like.

The toe-end sliding sleeve 3 is arranged on an upper end of the floating hoop 2, for performing a first-stage fracturing operation after the well cementation is completed. In a preferred embodiment of the present invention, the toe-end sliding sleeve 3 is a differential pressure sliding sleeve, which can be opened by pressure difference. In the embodiment shown in FIG. 1, two toe-end sliding sleeves 3 spaced from each other are provided along the axial direction of the pipe string 100. As a non-limiting example, the toe-end sliding sleeve 3 may be the one as disclosed in CN110374571A or CN209261535U.

The fracturing sliding sleeve 4 is arranged on an upper end of the toe-end sliding sleeve 3, for performing fracturing operations for other stages after the cementation is completed. Although only two fracturing sliding sleeves 4 are shown in FIG. 1 schematically, it can be understood that the pipe string 100 according to the present invention may include a plurality of fracturing sliding sleeves 4 spaced apart from each other along the axial direction of the pipe string. Preferably, the fracturing sliding sleeve 4 is a full-bore sliding sleeve, in order to realize stepless operation. As a non-limiting example, the fracturing sliding sleeve 4 may be the one disclosed in CN203603846U.

Preferably, the toe-end sliding sleeve 3 and the fracturing sliding sleeve 4 have the same inner diameter, which is equal to that of the tubing 5 of the pipe string 100, so as to ensure smooth passage of subsequent rubber plugs.

According to the present invention, the pipe string 100 may also include a centralizer 6. The centralizer 6 can play a centralizing role, and also reduce the friction force generated when the pipe string 100 runs in the wellbore, so as to ensure that the pipe string 100 can be lowered smoothly. In a preferred embodiment of the present invention, a plurality of centralizers 6 may be arranged in the axial direction of the pipe string 100 in sequence. The lowermost centralizer 6 is located between the floating shoe 1 and the floating hoop 2. Preferably, the distance between two adjacent centralizers 6 can be in a range of 20 to 40 m.

Figure 2:
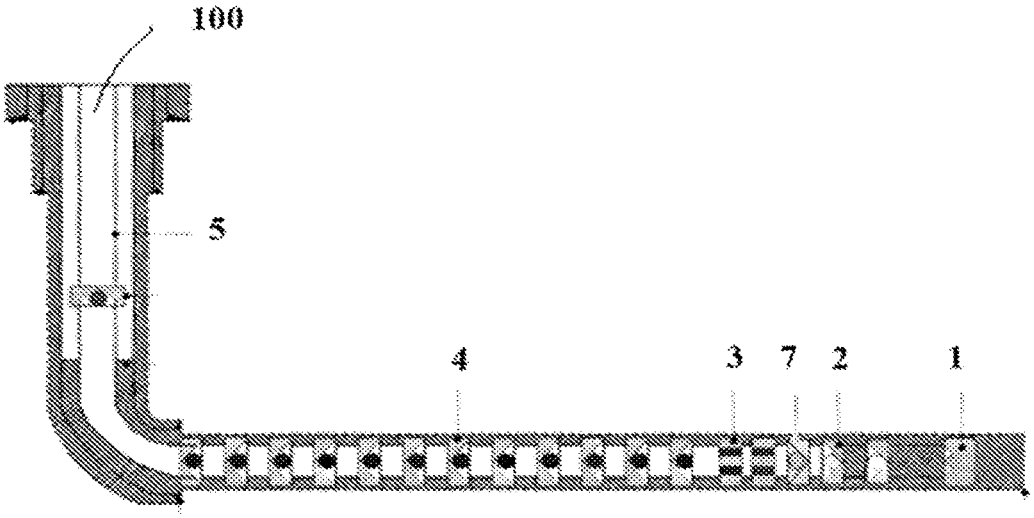
FIG. 2 shows a pipe string according to another embodiment of the present invention.

FIG. 2 shows a pipe string 100 according to another embodiment of the present invention, which is suitable for a horizontal well section. The structure of the pipe string 100 shown in FIG. 2 is substantially the same as that of the pipe string shown in FIG. 1, so that detailed description thereof is omitted here. In particular, FIG. 2 shows a plurality of fracturing sliding sleeves 4 arranged at intervals along the axial direction of the pipe string.

Figure 3:
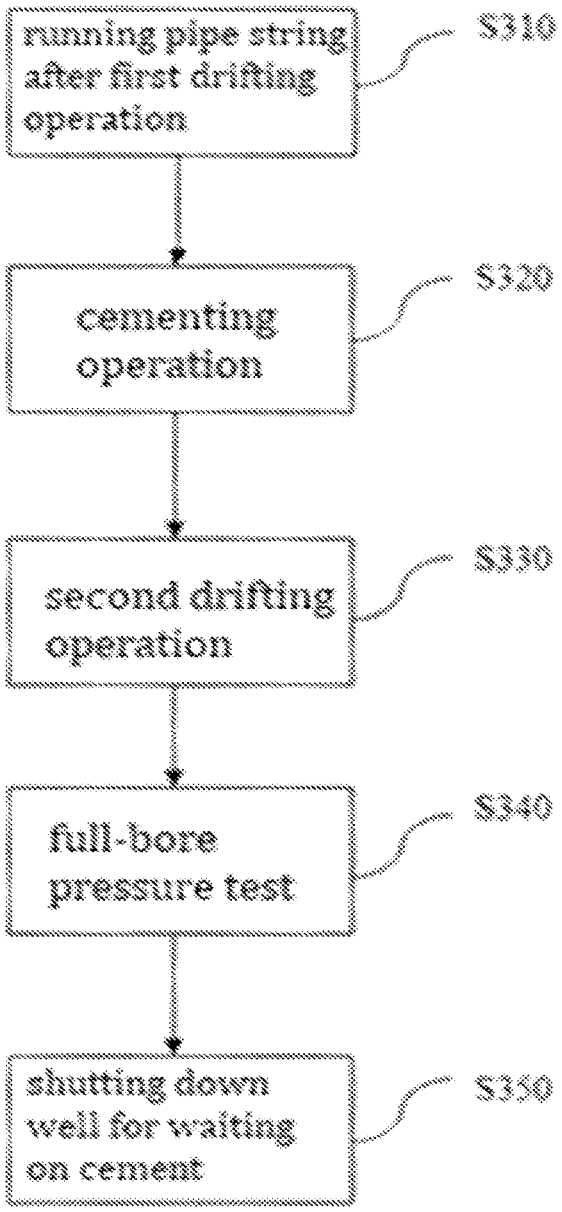
FIG. 3 is a flow chart of a wellbore staged operation method according to the present invention.
Figure 4:
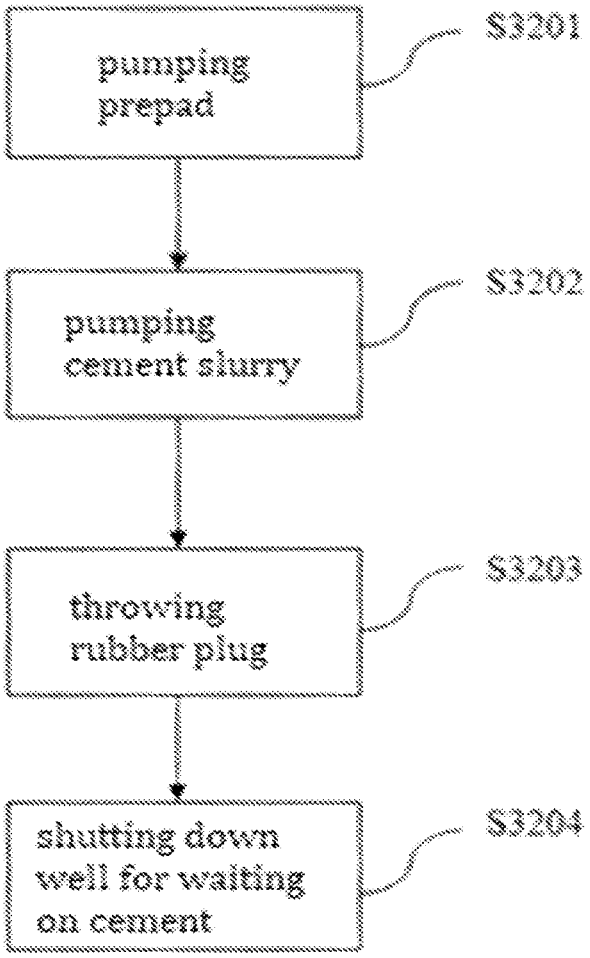
FIG. 4 is a flowchart of sub-steps of step S320 in FIG. 3.
Figure 5:
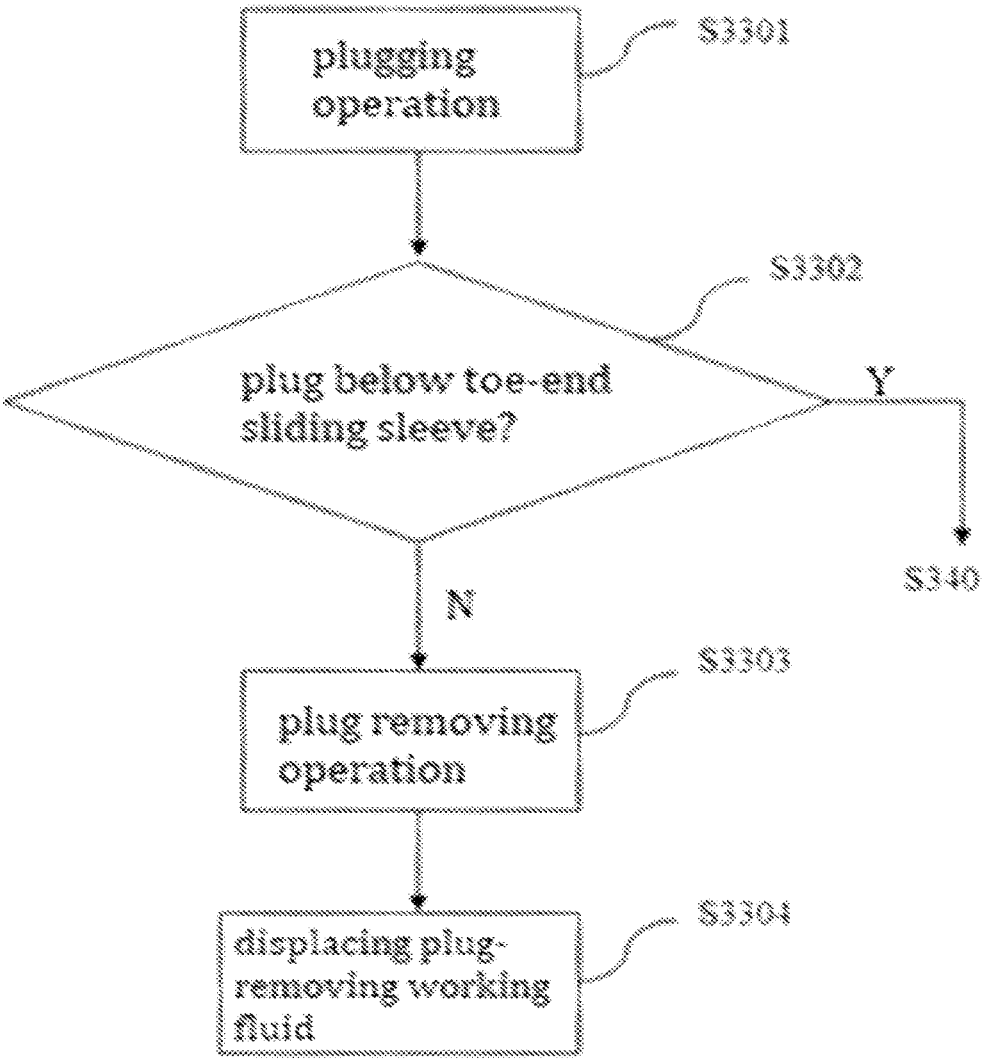
FIG. 5 is a flowchart of sub-steps of step S330 in FIG. 3.

FIG. 3 shows a flow chart of a wellbore staged operation method according to the present invention, which is preferably implemented with the above-mentioned pipe string 100.

First, the method starts from step S310, wherein a first drifting operation is performed after the drilling operation is completed, and then the pipe string runs in the wellbore. The first drifting operation can be performed with a drifting string to the bottom of the wellbore, so that the wellbore can meet the requirements for running the pipe string. During running, the upper end of the pipe string is fixedly connected to the wellhead device.

In step S320, a cementing operation is performed, wherein cement slurry pumped into the inner chamber of the pipe string enters an annulus between the pipe string and the wellbore through a plug seat and the floating hoop to form a cement sheath, which separates the toe-end sliding sleeve from the fracturing sliding sleeve.

According to a specific embodiment of the present invention, step S320 may include a preparatory step and four sub-steps. In the preparatory step, a cement tank is connected to the wellhead device, and pump suitable liquids into the pipe string according to a preset cementing procedure after a pressure test. This preparatory step is well known to one skilled in the art.

In sub-step S3201, a prepad liquid is first pumped into the pipe string, so that the prepad liquid can enter the annulus between the pipe string and the wellbore through the plug seat and the floating hoop for cleaning. For example, the prepad fluid may include a flushing fluid and a spacer fluid. The flushing fluid is pumped for the sake of washing out mud cakes formed on the well wall, so that the drilling fluid can flow easily. The spacer fluid is pumped for the sake of isolating the flushing fluid pumped first and the cement slurry pumped later from each other. In this way, the cement slurry will not mix with the mud slurry formed by the flushing fluid pumped first and the mud cakes to affect the quality of the cementation. According to a preferred embodiment of the present invention, the pumped prepad liquid can preferably form a liquid section with a length of 200-300 m in the wellbore.

In sub-step S3202, the cement slurry is pumped. The pumped cement slurry is, for example, a liquid fluid formed by cement, water and additives. During the pumping procedure, the cement slurry will enter the annulus between the pipe string and the wellbore through the plug seat and the floating hoop, thereby forming a cement sheath, which enables the toe-end sliding sleeve and the fracturing sliding sleeve (the lowermost one when there are multiple fracturing sliding sleeves) are spaced apart from each other. After a sufficient amount of cement slurry is pumped, sub-step S3202 terminates.

In sub-step S3203, a rubber plug (which will be described below with reference to FIGS. 6 to 8) is threw into the pipe string 100, and then a displacing fluid is pumped for driving the rubber plug to move downward, until it bumps against the plug seat. The displacing fluid is pumped to squeeze the cement slurry in the inner chamber of the pipe string into the annulus between the pipe string and the wellbore completely.

In sub-step S3204, the well is shut down for waiting on cement. At this time, the rubber plug has bumped with the plug seat and thus sat thereon. In a preferred embodiment, the pressure built up when the well is shut down is selected according to pressure difference of a liquid column, that is, it should be 3-5 MPa greater than the differential pressure of the liquid column to effectively prevent the cement slurry from backflow. During the waiting on cement, the cement slurry outside the pipe string is gradually cured, so that a cement sheath is formed between the outer wall of the pipe string 100 and the well wall of the formation. The cement sheath is located between the toe-end sliding sleeve and the fracturing sliding sleeve (the lowermost one when there are multiple fracturing sliding sleeves), thus achieving staged isolation effect.

In a preferred embodiment, during the cementing procedure, the return height of the cement slurry is designed according to particular well conditions, but must be at least 200 m higher than the uppermost fracturing sliding sleeve.

In step S330, a second drifting operation is performed to ensure that at least one toe-end sliding sleeve of the pipe string is exposed. According to a specific embodiment of the present invention, step S330 may include the following sub-steps.

In the second drifting operation, a plugging operation is first performed in sub-step S3301. In a preferred embodiment, the plugging operation can be performed with a coiled tubing connected with a plugging string. The outer diameter of the coiled tubing can be 20-30 mm smaller than the inner diameter of the pipe string, and the maximum outer diameter of the plugging string can be 3-5 mm smaller than the inner diameter of the pipe string. The lowering speed of the coiled tubing is preferably 10-20 m/min. When the coiled tubing is hindered at a certain position during running, the plugging operation can be repeated for several times through pressurization of 3-6 tons. If the hindering position remains unchanged, it can be judged that the hindering position is the position of the rubber plug.

Afterwards, in sub-step S3302, it is judged whether the position of the rubber plug is below the toe-end sliding sleeve 3. If yes (i.e., the position of the rubber plug is below the toe-end sliding sleeve 3), the method directly proceeds to the next step S340. If no (i.e., the position of the rubber plug is above the toe-end sliding sleeve 3), which means that the toe-end sliding sleeve cannot be opened smoothly, a further sub-step S3303 is required.

In sub-step S3303, a plug removing operation is performed to expose the toe-end sliding sleeve 3. In this way, the toe-end sliding sleeve 3 can be opened smoothly, thus ensuring that the first stage of fracturing can be carried out smoothly. In a preferred embodiment, the plug removing operation can be performed with the above coiled tubing connected with a plug-removing string. The maximum outer diameter of the plug-removing string can be 6-8 mm smaller than the inner diameter of the pipe string. This arrangement can ensure that cement debris generated by the plug removing operation can pass through the area between the plug-removing string and the pipe string without difficulties, thus facilitating smooth back-flow of the cement debris. Generally speaking, the plug removing operation is one of drilling out the rubber plug, which can be carried out to a position 10-20 m below the bottom surface of the toe-end sliding sleeve 3. This operation can ensure the smooth opening of the toe-end sliding sleeve 3, which is beneficial to meet the requirements of staged fracturing and later gas test.

In a specific embodiment, the inner diameter of the tubing is 88.3 mm. The assembly of the coiled tubing and the plug-removing string includes, from top to bottom, a coiled tubing with a diameter of 50.8 mm, a rivet joint with a diameter of 73 mm, a check valve with a diameter of 73 mm, a releasing tool with a diameter of 73 mm, a screw shaft with a diameter of 73 mm, and a drill bit with a diameter of 80 mm. During the plug removing operation, the pumping device pumps the working fluid from the coiled tubing, which drives the screw shaft to drive the drill bit in rotation to drill out the rubber plug. The pumped working fluid can be returned to the ground through the gap between the coiled tubing and the pipe string, and the cement debris generated by the plug removing operation can be brought back to the ground through the working fluid. During the plug removing operation, the displacement of the working fluid can be 300-500 L/min, in order to better control the speed of removing the plug. In this way, it can ensure not only effective removal of the plug, but also the cement debris will not be stuck in the gap between the coiled tubing and the pipe string.

In sub-step S3304, the plug-removing working fluid in the pipe string is displaced, in order to prevent the muddy plug-removing working fluid from entering and thus polluting the formation, so as to ensure smooth implementation of subsequent production operations. In a specific embodiment, the coiled tubing can be lowered into the pipe string, and then lifted up for a certain distance after touching the surface of the rubber plug. After that, a well-construction working fluid is pumped at a certain displacement to displace the plug-removing working fluid in the pipe string. The above lifting distance and the pumping displacement of the well-construction working fluid should be selected such that the working fluids will not mix with each other during the replacement of the plug-removing working fluid with the well-construction working fluid. In a specific example, the lifting distance is, for example, 2 m, and the pumping displacement of the well-construction working fluid is, for example, 250-350 L/min.

Preferably, the pumping pressure of the well-construction working fluid is decreased stepwise, thus ensuring that the well-construction working fluid in the pipe string can realize displacement of the plug-removing working fluid in a normal manner, and that flow-back of the fluids can be achieved smoothly. It should note here that according to different needs, the well-construction working fluid can be a working fluid of different properties, such as clean water. In some other cases, it is necessary to pump an acidic reaction fluid into the inner chamber of the pipe string during fracturing, for achieving dissolution of the sliding sleeve or a sliding-sleeve opening tool threw into the wellbore. In this case, it is necessary to pump a certain amount of spacer liquid before the acidic reaction liquid, in order to prevent or reduce the mixing of the acidic reaction liquid with the liquids injected in the pipe string. Accordingly, the efficiency of the acidic reaction liquid can be ensured, so that the dissolution of the sliding sleeve or the sliding-sleeve opening tool threw can be guaranteed. The amount of the spacer fluid and the acidic reaction fluid pumped can be adjusted according to different wells. In a specific embodiment, the inner diameter of the tubing is 88.3 mm. The well-construction working fluid includes the spacer fluid, the reaction fluid and clean water, which are pumped in sequence. The reaction liquid is of 2-7% dissolving agent, or contains 8-20% hydrochloric acid and 2-7% dissolving agent. 6 $m^3$ reaction fluid is pumped after 1 $m^3$ spacer fluid, and then clean water is supplied until the plug-removing working fluid in the wellbore is fully displaced. During the pumping procedure, the displacement may be 0.33 $m^3$/min, and the pumping pressure drops from an initial value of 36.0 MPa to 30.0 MPa gradually.

In step S340, a full wellbore pressure test is performed. For example, clean water is injected into the pipe string 100 from a gas recovery tree at the wellhead by means of the pumping truck, in order to perform the full wellbore pressure test. The test can be carried out in a form of stepwise pressurization, until the pressure reaches a predetermined ultimate strength. For example, the pipe string has a value of strength of 100 MPa, and the predetermined ultimate strength during the operation is 80 MPa by calculation. During the pressure test, a pressure fluid is initially pumped at 30 MPa, which is pressurized stepwise to, for example, 40 MPa, 50 MPa, 60 MPa, 70 MPa, 75 MPa, 78 MPa, 80 MPa in sequence.

In step S350, staged fracturing construction is performed. First, the pressure fluid is pumped into the inner chamber of the pipe string at a preset pressure value, which is achieved by the pump truck through pressurization, so as to open a corresponding toe-end sliding sleeve. After the toe-end sliding sleeve is opened, the pressure fluid will force the cement sheath at this location to be ruptured, thereby establishing a flow channel between the pipe string and the formation. Then, the fracturing construction of the first stage is carried out according to the fracturing design. Subsequently, according to the structure of the fracturing sliding sleeve, the sliding-sleeve opening tool is thrown into the pipe string. After the sliding-sleeve opening tool reaches in place, the lowermost fracturing sliding sleeve is opened by pressure accumulation to crush the cement sheath there. Afterwards, the second stage of fracturing construction can be carried out. The fracturing constructions for all subsequent stages can be carried out in sequence.

After the fracturing operation is completed, the fracturing equipment is removed from the well site. Then, the well is opened for fluid drainage, and test is performed for production. Finally, the pipe string can be put into production directly as a production string. These are well known to one skilled in the art.

According to the wellbore staged operation method of the present invention, well cementation and well completion operations can be performed by lowering the working string 100 in one trip. In particular, according to the present invention, the cement sheath formed during the well cementation is used as a spacer, for realizing staged stimulation for subsequent well completion. According to the wellbore staged operation method of the present invention, the staged fracturing construction can be implemented immediately after the well cementation, which simplifies the well cementation and well completion operations in the prior arts and improves the work efficiency. At the same time, the pipe string 100 according to the present invention has a simple structure, and can complete the well cementation and completion operations without devices such as perforating guns, packers or the like, which greatly saves equipment resources and effectively reduces the well construction costs.

In the wellbore staged operation method according to the present invention, the step of lowering the rubber plug to provide the bumping pressure with the plug seat is one of important steps. If the rubber plug cannot form effective bumping and locking, subsequent steps will be seriously affected. Therefore, according to another aspect of the present invention, a rubber plug suitable for the wellbore staged method according to the present invention is provided.

Figure 6:
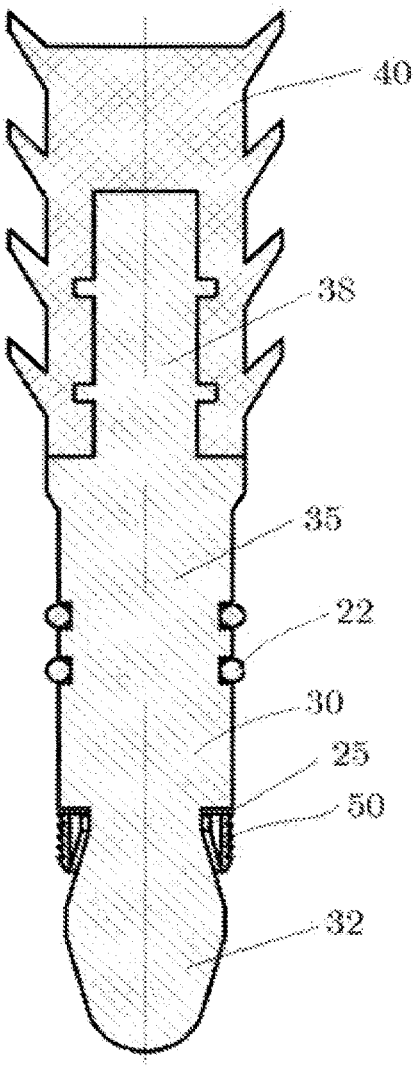
FIG. 6 shows a rubber plug according to an embodiment of the present invention.

The rubber plug 20 according to the present invention will be described in detail below with reference to FIGS. 6 to 8. As shown in FIG. 6, the rubber plug 20 mainly includes a plug core 30, a cup 40 and a locking member 50.

Figure 7:
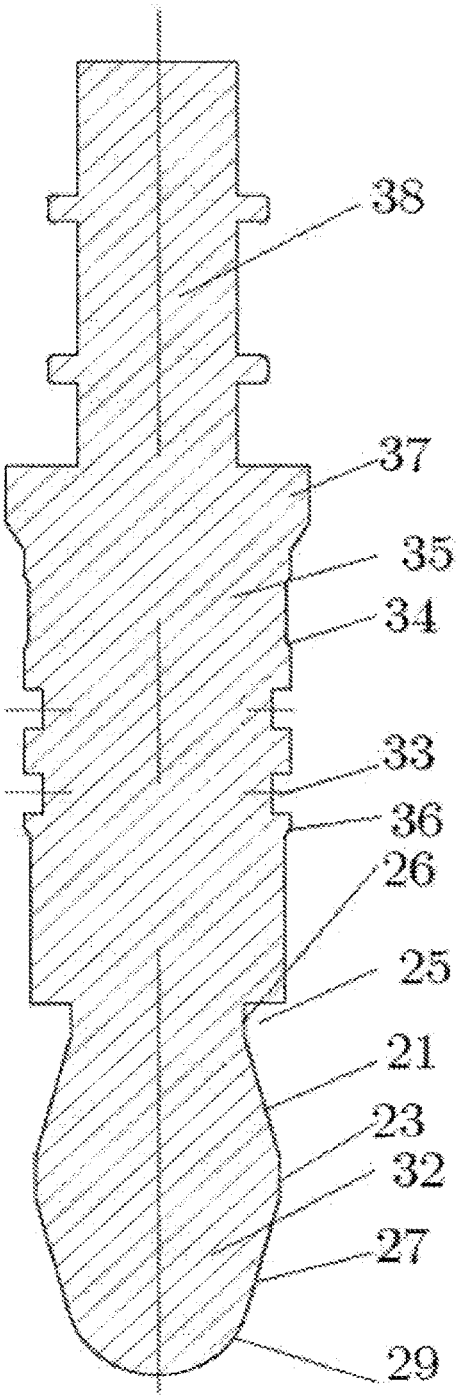
FIG. 7 shows a plug core of the rubber plug of FIG. 6.

As shown in FIG. 7, the plug core 30 is roughly rod-shaped, functioning as a skeleton for support. Along a direction from bottom to top, the plug core 30 has an inserting head 32, a main body 35 and a connecting tail 38 which are fixedly connected with each other in sequence. An annular mounting groove 25 is provided on an outer wall of the inserting head 30, for mounting the locking member 50 therein. The cup 40 is arranged around an outer wall of the connecting tail 38, for scraping off the cement slurry by contacting an inner wall of the tubing during the displacement procedure.

According to the present invention, the mounting groove 25, in which the locking member 50 is arranged, is provided on the outer wall of the inserting head 32 of the plug core 30. After the cement slurry has been injected for cementation, the rubber plug 20 according to the present invention is lowered into the tubing. When the rubber plug 20 moves to the plug seat 7, the locking member 50 will form a locking fit with a mating locking member on the plug seat 7. Since the locking member 50 is restricted in the mounting groove 25, the plug core 30 will be fixed relative to the locking member 50, thereby defining the position of the rubber plug 20. In this way, the back-flow of the cement slurry can be effectively avoided, thus improving the quality of tubing cementation. Therefore, the quality of the wellbore in which subsequent completion tools are lowered can be guaranteed.

In one embodiment, as shown in FIG. 7, the mounting groove 25 includes a first straight section 26 adjacent to the main body 35 of the plug core 30, and a first slope section 21 adjacent to the first straight section 26. In a direction from top to bottom, the first slope section 21 is configured such that an outer diameter of the inserting head 32 gradually increases.

Figure 8:
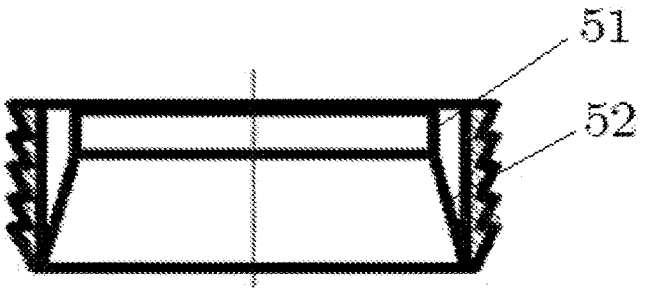
FIG. 8 shows a locking element of the rubber plug of FIG. 6.

In one embodiment, as shown in FIG. 8, the locking member 50 is configured as a C-shaped ratchet ring. An inner wall surface of the C-shaped ratchet ring includes a first straight mating section 51 at its upper part, for cooperating with the first straight section 26. In addition, the inner wall surface of the C-shaped ratchet ring further includes a first slope mating section 52 at its lower part, for cooperating with the first slope section 21. After installation, an upper end face of the C-shaped ratchet ring abuts against a lower end face of the main body 35 of the plug core 30. In this way, after the locking element 50 forms a locking fit with the mating locking element on the plug seat 7, the C-shaped ratchet ring can be effectively prevented from falling off due to the restriction of the lower end face of the main body 35 on the upper end face of the C-shaped ratchet ring and the cooperation between the first slope mating section 52 and the first slope section 21, even if the plug core 30 is subjected to an upward force by the cement slurry. Accordingly, safety and stability of the locking of the rubber plug 20 can be ensured.

As shown in FIG. 7, the inserting head 32 of the plug core 30 includes a second straight section 23 connected to the first slope section 21. Below the second straight section 23, a second slope section 27 and a guide section 29 are arranged in sequence. The second slope section 27 is configured such that the outer diameter of the inserting head 32 gradually decreases in the direction from top to bottom. The guide section 29 is preferably configured as a part of a spherical surface. With the above arrangement, the inserting head 32 has the largest outer diameter at an area where the second straight section 23 is located. That is, the inserting head 32 is configured to have a large outer diameter in the middle and a small outer diameter at both ends, forming a shape like a date pit. In addition to ensuring the stability of the locking engagement, this structure further provides good guidance, ensures smooth lowering of the rubber plug 20, and avoids jamming at any step face of the pipe string.

According to the present invention, at least one sealing groove 33 is formed on the outer wall of the main body 35 for mounting sealing ring 22 therein, so as to realize the sealing effect of cementation. With this arrangement, the sealing ring 22 is located above the locking member 50, so that the locking member 50 will not pass through the sealing groove 33 during assembly. Accordingly, the locking member 50 will not come into contact with the sealing ring 22 to damage the sealing surface. Preferably, a first step face 34 facing upwardly is formed on the outer wall of the main body 35, and a second step face 36 facing downwardly and axially spaced apart from the first step face 34 is also formed on the outer wall of the main body 35, wherein the second step face 36 is located below at the first step face 34. With this arrangement, a projecting part protruding radially outward is formed on the outer wall of the main body 35.

In one embodiment, the sealing groove 33 is located between the first step face 34 and the second step face 36. Therefore, the sealing groove 33 is located on the projecting part of the main body 35. On the one hand, this arrangement realizes that the outer diameter of the main body 35 below the second step face 36 is relatively smaller, which is convenient for lowering. On the other hand, the axial size of the main body 35 between the first step face 34 and the second step face 36 is relatively small, which can avoid excessive wear of the sealing ring 22. Preferably, an angle between the first step face 34 and the axial direction of the plug core 30 is 130-140 degrees, such as, 135 degrees, while an angle between the second step face 36 and the axial direction of the plug core 30 is 145-155 degrees, such as, 150 degrees.

Preferably, a transiting section 37 with an increased outer diameter is provided at the upper end of the main body 35. After the cup 40 is placed on the connecting tail 38 of the plug core 30, the outer diameter of a main body of the cup 40 is the same as that of the transiting section 37. In addition, the plug core 30 is formed as one single piece, wherein the rubber cup 40 is arranged on the outer wall of the connecting tail 38 of the plug core 30 through vulcanization. This arrangement can ensure the overall strength of the plug core 30, so that there is no weak part in the whole rubber plug 20, which is beneficial to improve safety. At the same time, the above arrangement ensures a stable connection between the cup 40 and the plug core 30, thus ensuring the quality of displacement.

According to a preferred embodiment, the C-shaped ratchet ring is made of 42CrMo alloy steel, thereby improving the ability of the C-shaped ratchet ring resistant to pressure difference. In this way, such C-shaped ratchet ring can be used in wells with harsher conditions and larger pressure difference in the well cementation (for example, a pressure difference of 60-70 MPa). In order to ensure the wear resistance and temperature resistance of the cup 40, it can be made of compounds such as nitrile rubber, fluorine rubber, natural rubber, or the like. Of course, the proportions of the components of the cup 40 can also be properly adjusted according to actual conditions, so as to meet related requirements.

While the present invention has been described above with reference to the exemplary embodiments, various modifications may be made and components may be replaced with equivalents thereof without departing from the scope of the present invention. In particular, as long as there is no structural conflict, each technical feature mentioned in each embodiment can be combined in any manner. The present invention is not limited to the specific embodiments disclosed herein, but includes all technical solutions falling within the scope of the claims.

The invention claimed is:

1. A wellbore staged operation method, comprising steps of:

performing a first drifting operation on a wellbore;

running a pipe string in the wellbore, wherein the pipe string comprises, along a direction from bottom to top, a floating hoop, a plug seat, a toe-end sliding sleeve, and a fracturing sliding sleeve that are spaced apart from one another;

performing a cementing operation;

performing a second drifting operation to expose the toe-end sliding sleeve of the pipe string;

performing a pressure test for the pipe string; and performing staged fracturing construction, wherein performing the cementing operation comprises:

cleaning the wellbore by pumping a prepad liquid into the pipe string and then, through the plug seat and the floating hoop, into an annulus disposed between the pipe string and the wellbore;

pumping a cement slurry into the pipe string to enter the annulus through the plug seat and the floating hoop to form a cement sheath, the cement sheath isolating the toe-end sliding sleeve from the fracturing sliding sleeve;

pumping a displacing fluid with a rubber plug into the pipe string to cause the rubber plug to contact the plug seat; and causing a pressure buildup and a hardening of the cement slurry in the annulus to form a cement sheath, and wherein the step of performing the second drifting operation comprises:

performing a plugging operation to determine a position of the rubber plug;

judging a position of the rubber plug relative to the toe-end sliding sleeve; and when the position of the rubber plug is above the toe-end sliding sleeve, performing a plug-removing operation using a coiled tubing connected to a plugging string or a plug-removing string to remove the plug from the plug seat.

2. The method according to claim 1, wherein the prepad liquid forms a liquid section of a length of 200-300 m in the annulus.

3. The method according to claim 1, wherein the cement sheath is of a length of at least 200 m above the fracturing sliding sleeve.

4. The method according to claim 1, wherein the built-up pressure is 3-5 MPa higher than a pressure of the liquid column.

5. The method according to claim 1, wherein the plugging operation is performed with the coiled tubing connected to the plugging string, wherein an outer diameter of the coiled tubing is 20-30 mm smaller than an inner diameter of the pipe string, and a maximum outer diameter of the plugging string is 3-5 mm smaller than the inner diameter of the pipe string, the coiled tubing having a running speed of 10-20 m/min.

6. The method according to claim 1, wherein the plug-removing operation is performed by the coiled tubing connected with the plug-removing string, a maximum outer diameter of the plug-removing string being 6-8 mm smaller than the inner diameter of the pipe string.

7. The method according to claim 6, wherein in the plug-removing operation, the rubber plug is drilled out to a position 10-20 m below a bottom surface of the toe-end sliding sleeve.

8. The method according to claim 6, wherein the rubber plug is drilled out through pumping a plug-removing working fluid to drive a drill bit via the plug-removing string, the plug-removing working fluid being pumped with a displacement of 300-500 L/min.

9. The method according to claim 1, wherein an operation of displacing the plug-removing working fluid in the pipe string is performed after the plug-removing operation.

10. The method according to claim 9, wherein the coiled tubing is lifted up after contacting with the rubber plug in the pipe string, and a well-construction working fluid is pumped to displace the plug-removing working fluid in the pipe string.

11. The method according to claim 10, wherein a pressure of the well-construction working fluid decreases stepwise.

12. The method according to claim 10, wherein the well-construction working fluid is a reaction fluid acting on the sliding sleeves of the pipe string, and wherein a spacer liquid is pumped before the well-construction working fluid.

* * * * *